US005979693A

United States Patent [19]

Bane, III

[11] Patent Number: 5,979,693

[45] Date of Patent: Nov. 9, 1999

[54] PANEL FOR SHIPPING CONTAINERS

[76] Inventor: William W. Bane, III, 1608 N. Franklin St., Wilmington, Del. 19806

[21] Appl. No.: 08/998,936

[22] Filed: Dec. 29, 1997

[51] Int. Cl.[6] ..... B65D 25/16

[52] U.S. Cl. ..... 220/592.2; 220/4.28; 220/23.9; 220/592.23; 220/592.26; 220/921

[58] Field of Search ..... 220/4.28, 6, 23.9, 220/1.5, 1.6, 592.2, 592.21, 592.23, 592.25, 592.26, 592.27, DIG. 9, 921, 920, 918, 495.06, 23.83, 23.86, 62.18, 62.2, 62.21, 62.22, 671, 675, 902; 206/523

[56] References Cited

U.S. PATENT DOCUMENTS

| | | | |
|---|---|---|---|
| 2,523,145 | 9/1950 | Robinson . | |
| 2,808,192 | 10/1957 | Raisin . | |
| 2,817,123 | 12/1957 | Jacobs . | |
| 2,939,811 | 6/1960 | Dillon . | |
| 2,998,337 | 8/1961 | Tillotson . | |
| 3,160,307 | 12/1964 | Morrison . | |
| 3,172,593 | 3/1965 | Potter . | |
| 3,220,595 | 11/1965 | Edwards | 220/595.25 |
| 3,251,382 | 5/1966 | Tatsch . | |
| 3,264,165 | 8/1966 | Stickel . | |
| 3,344,973 | 10/1967 | Studen . | |
| 3,420,022 | 1/1969 | Brock . | |
| 3,640,832 | 2/1972 | Kurz . | |
| 3,681,092 | 8/1972 | Titchenal et al. . | |
| 3,786,710 | 1/1974 | Backlin . | |
| 3,802,591 | 4/1974 | Mizushima et al. . | |
| 3,890,762 | 6/1975 | Ernst et al. . | |
| 3,958,391 | 5/1976 | Kujubu . | |
| 4,010,865 | 3/1977 | Wilgus . | |
| 4,039,297 | 8/1977 | Takenaka | 220/592.25 |
| 4,269,323 | 5/1981 | Ito et al. . | |
| 4,282,973 | 8/1981 | Binkowski . | |
| 4,339,039 | 7/1982 | Mykleby | 220/918 |
| 4,373,643 | 2/1983 | Przytarski | 220/592.2 |
| 4,468,913 | 9/1984 | Guillon et al. . | |
| 4,642,970 | 2/1987 | Bane . | |
| 4,730,748 | 3/1988 | Bane . | |
| 4,796,758 | 1/1989 | Hauk . | |
| 5,105,970 | 4/1992 | Malone et al. . | |
| 5,143,245 | 9/1992 | Malone . | |
| 5,154,309 | 10/1992 | Wischusen, III et al. . | |
| 5,226,557 | 7/1993 | Nelson . | |
| 5,351,846 | 10/1994 | Carter | 220/6 |
| 5,441,170 | 8/1995 | Bane, III . | |
| 5,492,240 | 2/1996 | Vilutis . | |
| 5,562,228 | 10/1996 | Ericson . | |
| 5,598,943 | 2/1997 | Markus . | |

*Primary Examiner*—Stephen Castellano
*Attorney, Agent, or Firm*—Shlesinger, Arkwright & Garvey LLP

[57] ABSTRACT

An insulated wall panel for a shipping container, comprising a base panel having an outer surface, a first end and an opposite second end, at least one rib being disposed on the outer surface and substantially extending from the first end to the second end, a film being at least partially disposed over the base panel and the rib creating a first and second enclosure between the film, the base panel and the rib, and the first and second enclosures being independent from each other with substantially no convection therebetween.

40 Claims, 4 Drawing Sheets

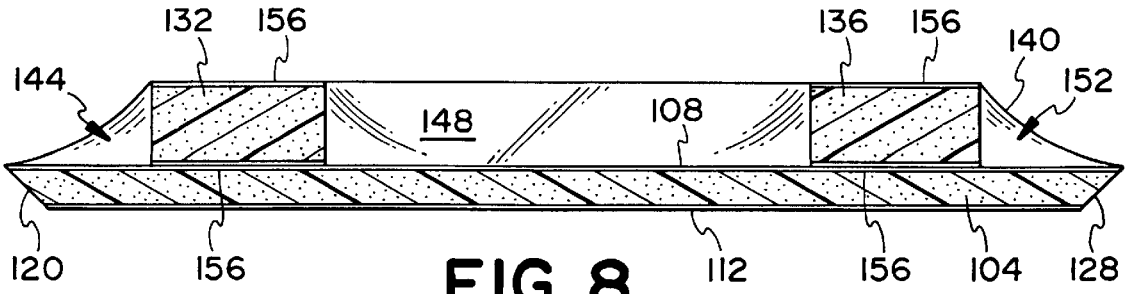
FIG. 8
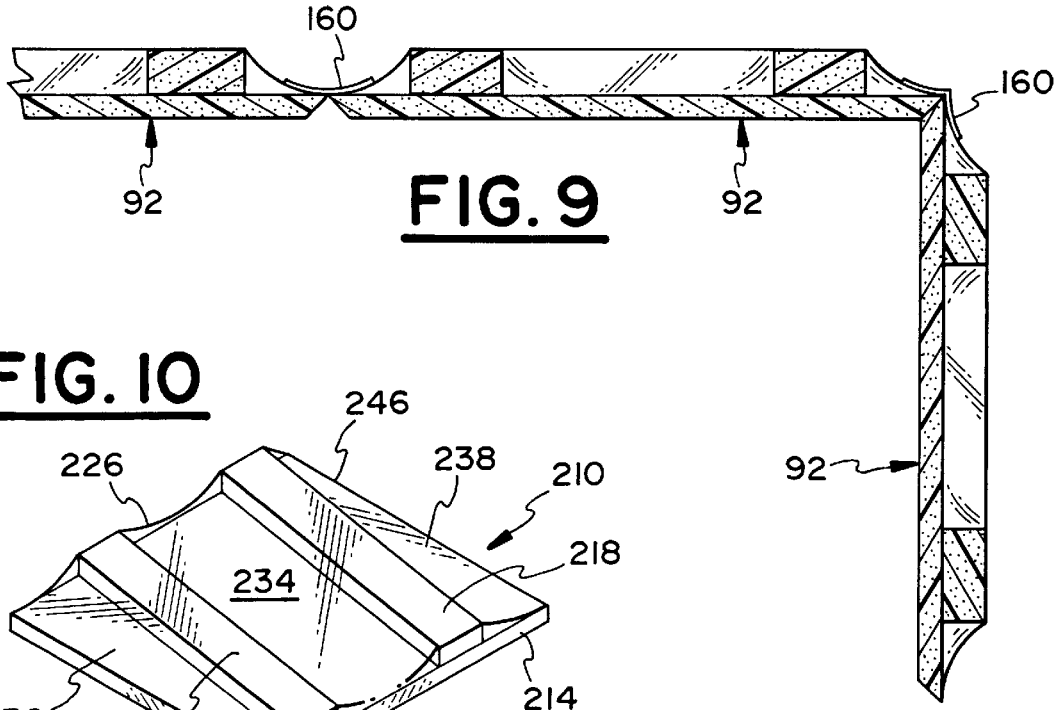
FIG. 9
FIG. 10
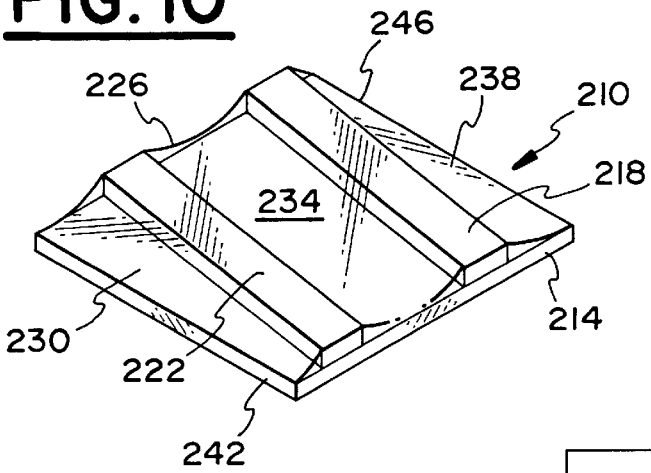
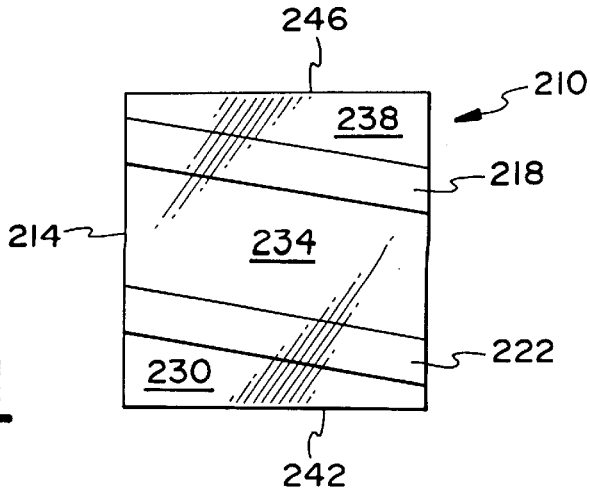
FIG. 11

PANEL FOR SHIPPING CONTAINERS

FIELD OF THE INVENTION

This invention relates generally to insulated containers and more particularly insulating panels for use within a shipping container.

BACKGROUND OF THE INVENTION

Many industries have encountered a need for transporting perishable materials or materials which are temperature sensitive. One such industry is the medical field which may require a transportation of small quantities of temperature sensitive material, such as organs or blood, between two distant locations. A conventional container having a large and bulky self-contained refrigeration unit that provides environmental and temperature control is not efficient in transporting small quantities of material. Additionally, containers having self-contained refrigeration units are expensive. The containers having self-contained refrigeration units are generally only employed when shipping large quantities of temperature sensitive materials.

The materials being shipped must also be protected from violent impacts and rough handling that often occurs during shipping. Accordingly, a shipping container must also be of sound structural integrity to protect the valuable and often life saving cargo. Additionally, sometimes during shipping, containers are punctured by various objects. Thus, it is also important for the container to protect the cargo from punctures.

Accordingly, over the years, there has developed a need for a space and economically efficient container that can substantially maintain a temperature so that a small quantity of temperature sensitive material can be transported between two distant locations.

A container is disclosed in Malone et al., U.S. Pat. No. 5,105,970. This patent discloses an insulating system to retrofit a conventional uninsulated container, having multiple insulating panels, with each panel having a plurality of foam strips attached to the walls of the container. Each foam strip does not span across the entire surface of the wall. Rather, the plurality of strips are spaced out across the surface of the wall. An insulated blanket is affixed to the strips. Because the insulated blanket is supported off from the surface of the wall by the foam strips, an air compartment is created between the insulated blanket and the wall. The insulated blanket is comprised of a plurality of separate closed air cells. Because the foam strips do not extend all the way across the surface of the walls, the air trapped between the blanket and the wall is allowed to flow freely from one end of the panel to the other, thus, providing little protection against heat transfer along the surface of the wall.

Malone, U.S. Pat. No. 5,143,245 discloses an insulating retrofitting system related to the system disclosed in Malone, U.S. Pat. No. 5,105,970.

Others have also attempted to develop efficient insulated shipping containers, such as the ones disclosed in: Nelson, U.S. Pat. No. 5,226,557; Guillon et al., U.S. Pat. No. 4,468,913; Hauk, U.S. Pat. No. 4,796,758; Markus, U.S. Pat. No. 5,598,943; Ericson, U.S. Pat. No. 5,562,228; Vilutis, U.S. Pat. No. 5,492,240; and, Wischusen, III et al., U.S. Pat. No. 5,154,309.

None of these patents adequately solve the problem of providing a reusable insulating panel for a shipping container or an insulated shipping container that permits temperature sensitive materials to be shipped between two distant locations without the need of external refrigeration. Additionally, none of these patents disclose a reusable insulated shipping container which is capable of withstanding rough handling by a courier or the possibility of puncturing of the exterior container without damaging the cargo. In particular, none of the patents disclose an insulating panel for a shipping container which has a plurality of independent dead air compartments which extend across the entire surface of a panel, not allowing convection between the plurality of dead air compartments.

OBJECTS AND SUMMARY OF THE INVENTION

It is an object of the present invention to provide a reusable insulating panel that can be used in a shipping container to allow temperature sensitive materials to be transported over an extended period of time without the need for external temperature control.

A further object of the present invention is to provide an insulating panel for use with a shipping container that utilizes the least amount of material in the most efficient way to provide adequate insulation.

Yet, another object of this invention is to provide a reusable insulating panel for use with a shipping container that separates material being shipped from the exterior shipping container to protect the often fragile cargo from objects that may puncture the shipping container.

Still, a further object of this invention is to provide a reusable insulating panel for use with a shipping container that provides structural integrity to the shipping container.

A further object of this invention is to provide a reusable insulating panel for use with a shipping container that provides impact protection for the material being shipped.

Yet, a further object of the present invention is to provide a reusable insulating plate member for use with a shipping container that employs a plurality of separate and independent dead air compartments, which are co-extensive with the face of the plate member whereby convection is not allowed between the compartments.

Still, a further object of the present invention is to provide a shipping container having a plurality of insulating plate members with separate and independent dead air compartments thereon; which is inexpensive to manufacture; uses the least amount of materials in the most efficient way; allows temperature sensitive material to be effectively protected from damage during shipping; and, substantially maintains the temperature of the cargo throughout the duration of the transportation.

In summary, the present invention discloses a novel configuration for an insulating wall panel for a shipping container that includes a base panel having an outer surface, a first end and a second end, at least one rib being disposed on the outer surface and substantially extending from the first end to the second end, a film being disposed over the base panel and the rib creating a first and second enclosure between the film, the base panel and the rib, and the first and second enclosures being independent from each other with substantially no convection therebetween.

Also disclosed is an insulated container comprising a plurality of side members being at least partially interconnected, at least one closure member being selectively engaged with the side members, and at least one of the side members and the closure member comprising a base panel having edges and at least one rib disposed on the base panel, and a film at least partially sheathing at least one of the side members and the closure member, thereby forming a first and second chamber between the rib and the edges, the chamber being independent from one another substantially preventing convection flow between said chambers.

Also disclosed is a reusable insulated box, comprising a plurality of side members each having a top edge, a top member being selectively disposed on the top edge of the side members, the side and top members each comprising a base panel having edges and a plurality of ribs disposed on the base panel, and the side and top members being sheathed in a film forming separate independent air pockets between the ribs and the ends of the base. panel.

The present invention also discloses a method of packaging an object for shipping, comprising the steps of providing a box, providing insulating panels inside the box, spacing the insulating panels a distance away from the sides of the box, creating dead-air space between the panels and the sides of the box and placing the object within the enclosure defined by the panels.

These and other objects of the invention will be apparent from the following detailed description.

DESCRIPTIONS OF THE DRAWINGS

FIG. 8 is a side cross sectional view of a side panel of the shipping container shown in FIG. 4;

FIG. 9 is a partial cross sectional view of some of the side panel members connected together;

FIG. 10 is an isometric view of an alternative embodiment of a reusable insulating panel, made in accordance with the present invention; and, FIG. 11 is a top view of the reusable insulating panel shown in FIG. 10.

DETAILED DESCRIPTION OF THE INVENTION

FIGS. 1 AND 2

Figure 1:
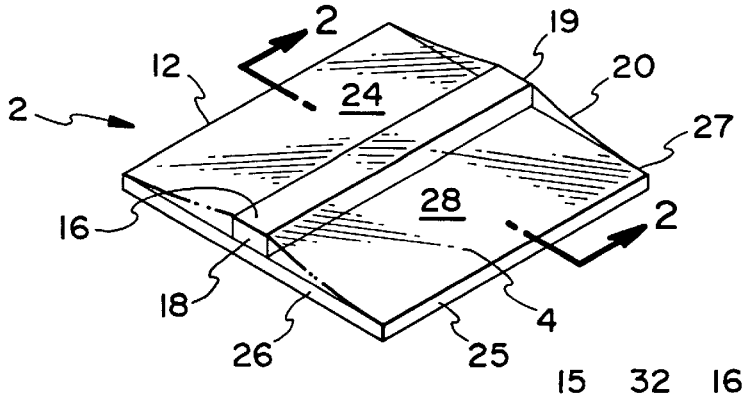
FIG. 1 is an isometric view of a reusable insulated panel for use in connection with a shipping container, made in accordance with the present invention.
Figure 2:
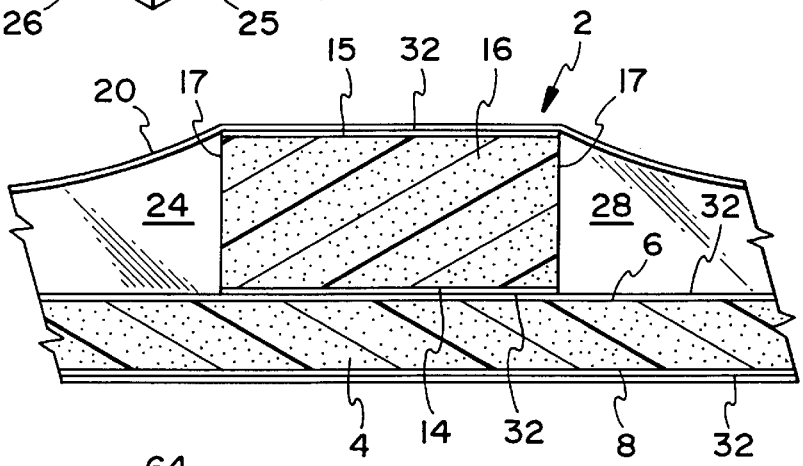
FIG. 2 is an enlarged fragmentary cross sectional view of the reusable insulating panel taken along the line 2—2 of FIG. 1.

Shown in FIGS. 1 and 2, is a reusable insulating panel 2, made in accordance with the present invention, for use in connection with a shipping container, not shown. Panel 2 comprises a base member 4, having a first surface 6, a second surface 8, four sides or ends 12, 25, 26 and 27, a rib 16 and a film 20.

Base member 4 is generally of a rectangular configuration. However, base member 4 may be of numerous configurations depending on the application. Base member 4 is preferably comprised of a diisocyanate foam composition, such as polyurethane. Diisocyanate foams are preferred owing to their structural rigidity and their superior insulation properties. However, those skilled in the art will appreciate that various other foams, such as, for example, polystyrene, may be adapted to provide the requisite properties.

Rib 16 is generally of a rectangular configuration. Rib 16 may be of numerous configurations depending on the application. Rib 16 is also preferably comprised of a diisocyanate foam composition such as polyurethane. As noted above, other materials may be adapted to provide the requisite properties also.

Rib 16 has an attachment face 14, a freeface 15 and sides 17. Rib 16 also has a first end 18 and a second end 19. The thickness of rib 16, namely, the distance between attachment face 14 and freeface 15, may be lesser than or greater than the thickness of base member 4, namely, the distance between first surface 6 and second surface 8.

The thickness of rib 16 is preferred to be greater than the thickness of base member 4. More particularly, the thickness of rib 16 is preferred to be about at least 2 times greater than the thickness of base member 4.

Rib 16 is disposed on either first surface 6 or second surface 8 of base member 4 such that the length of rib 16, namely, the distance from first end 18 to second end 19, substantially extends across the entire surface 6 or 8. As shown in FIGS. 1 and 2, rib 16 is disposed on first wall 6. For discussion purposes, rib 16 will be referred to as being disposed on first surface 6, although, it is understood that it could be disposed on either surface 6 or 8.

The width of rib 16, namely, the distance between sides 17, is lesser than the width of base member 4, namely, the distance between side 12 and 25. Preferably, the width of member 16 is substantially less than the width of base member 4. The width of base member 4 may be about nine times greater than the width of rib 16.

Attachment face 14 is disposed adjacent first surface 6. Rib 16 may be attached to base member 4 by numerous means such as gluing, taping, hook and loop fasteners or any other means which will hold it to base member 4. Rib 16 may also be held in place adjacent base member 4 by the forces exerted upon it by film 20, as will be discussed further below.

Rib 16 has a length 22 that extends from first end 18 to second end 19. Base member 4 has a length 9 that extends from side 26 to and an opposite side 27. The length of rib 16 is substantially equal to the length of base member 4. The length of rib 16 preferably is exactly equal to the length of base member 4. This is true when rib 16 extends in a parallel relationship with a side 25 and 12 of base member 4.

Rib 16 is disposed on base member 4 such that first end 18 substantially aligns with side 26 and second end 19 substantially aligns with opposite side 27. In other words, rib 16 substantially extends all the way across first surface 6, as set forth above.

As will be set forth further below, rib 16 may be in an offset positional relationship with sides 12 and 25, thus making its overall length not substantially equal to the length of the base member 4, see FIGS. 10 and 11.

Film 20 is a heat shrinkable thermoplastic insulating film. Film 20 is preferably, a poly-vinyl chloride film and has a thickness of from about 0.5 mils to approximately 1.5 mils when in an unshrunk state. Suitable film 20 may be purchased from DuPont under their trademark, CLYSAR, or from D.R. Grace under their trademark, CRAOVAK.

Film 20 is wrapped over at least, rib 16 and first surface 6 so as to create a first enclosure 24 and a second enclosure 28. Film 20 is arranged on base member 4 so as to substantially entrap air between itself, base member 4 and rib 16 within first and second enclosures 24 and 28.

Enclosures 24 and 28 are independent of each other, meaning that generally, air cannot naturally flow from one enclosure to the other. In other words, there is no air circulation between enclosure 24 and enclosure 28. Enclosures 24 and 28 extend across the entire first surface 6 of base member 4. Enclosures 24 and 28 provide an insulating barrier. Enclosures 24 and 28 may be filled with other gases other than simply air. Because rib 16 substantially extends entirely across base member 4, enclosures 24 and 28 also substantially extend across base member 4.

Film 20 may be wrapped around base member 4, including rib 16, in an effort to sheath the entire panel. Film 20 does not have to wrap completely around rib 16 in base member 4. In other words, film 20 may simply be placed over the base member 4 and rib 16 combination, so long as the independent enclosures or air spaces 24 and 28 are created.

Film 20 is used to create enclosures 24 and 28 and also to allow panels to be easily cleaned for reuse.

Optional reflective layers or material 32 may be added to panel 2. Reflective layers 32 can be bonded to either or both first and second surface 6 and 8 of base number 4. Additionally, reflective layers 32 can be bonded to either or both faces 14 and 15 of rib 16. Preferably, the reflective layers 32 are comprised of an aluminized coating which is bonded to the respective surfaces. Reflective layers 32 will aid in improving the insulation properties of panel 2.

FIGS. 3 AND 4

Figure 3:
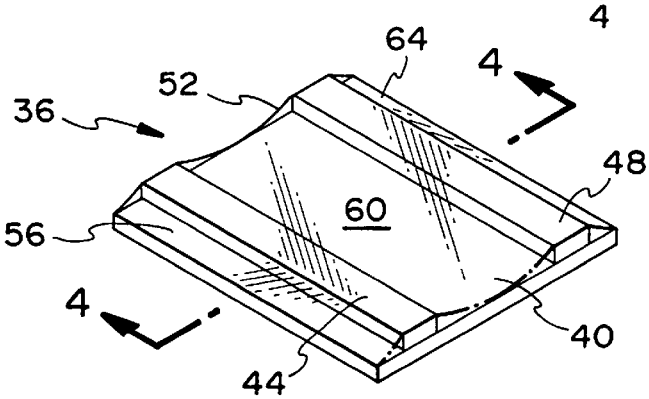
FIG. 3 is an isometric view of another embodiment of a reusable insulating panel, made in accordance with the present invention.
Figure 4:
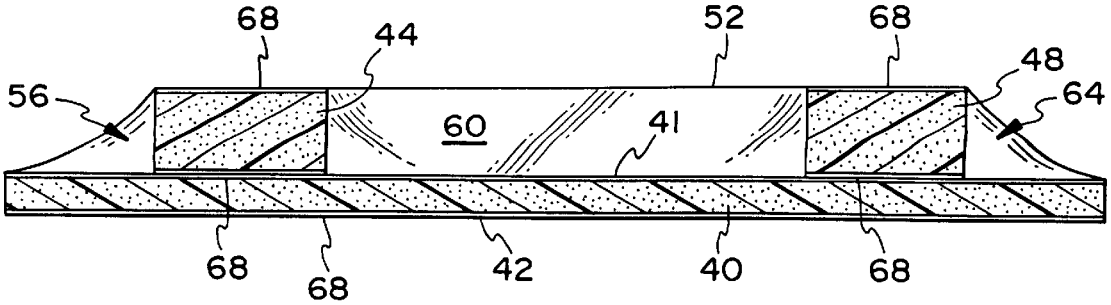
FIG. 4 is an enlarged side cross sectional view of the reusable insulating panel shown in FIG. 3.

FIGS. 3 and 4 display an alternative embodiment of a reusable insulating panel, made in accordance with the present invention, for use in connection with shipping container. Namely, second panel 36 is shown in a cross-sectional side elevational view.

Second panel 36 is comprised of a base number 40, a first rib 44, and a second rib 48 all wrapped in a film 52 thereby creating a first enclosure or dead air space 56 and second enclosure or dead air space 60 and a third enclosure or dead air space 64.

Note, ribs 44 and 48 are shown attached to first surface 41 of base member 40. It is understood that ribs 44 and 48 could be alternatively attached to second surface 42 of base member 40. As with panel 2, second panel 36 may also have reflective material or layers 68. Reflective layers 68 are optional and again may be employed on the rib faces as well as the surfaces 41 and 42 of base member 40. Ribs 44 and 48 are arranged on base member 40, similar to how rib 16 is arranged on member 4, disclosed above.

Second panel 36 shows the use of several ribs to provide more than two dead air spaces. Accordingly, it is understood that there may be additional ribs in order to create more dead air spaces.

FIGS. 5, 6 AND 7

Figure 5:
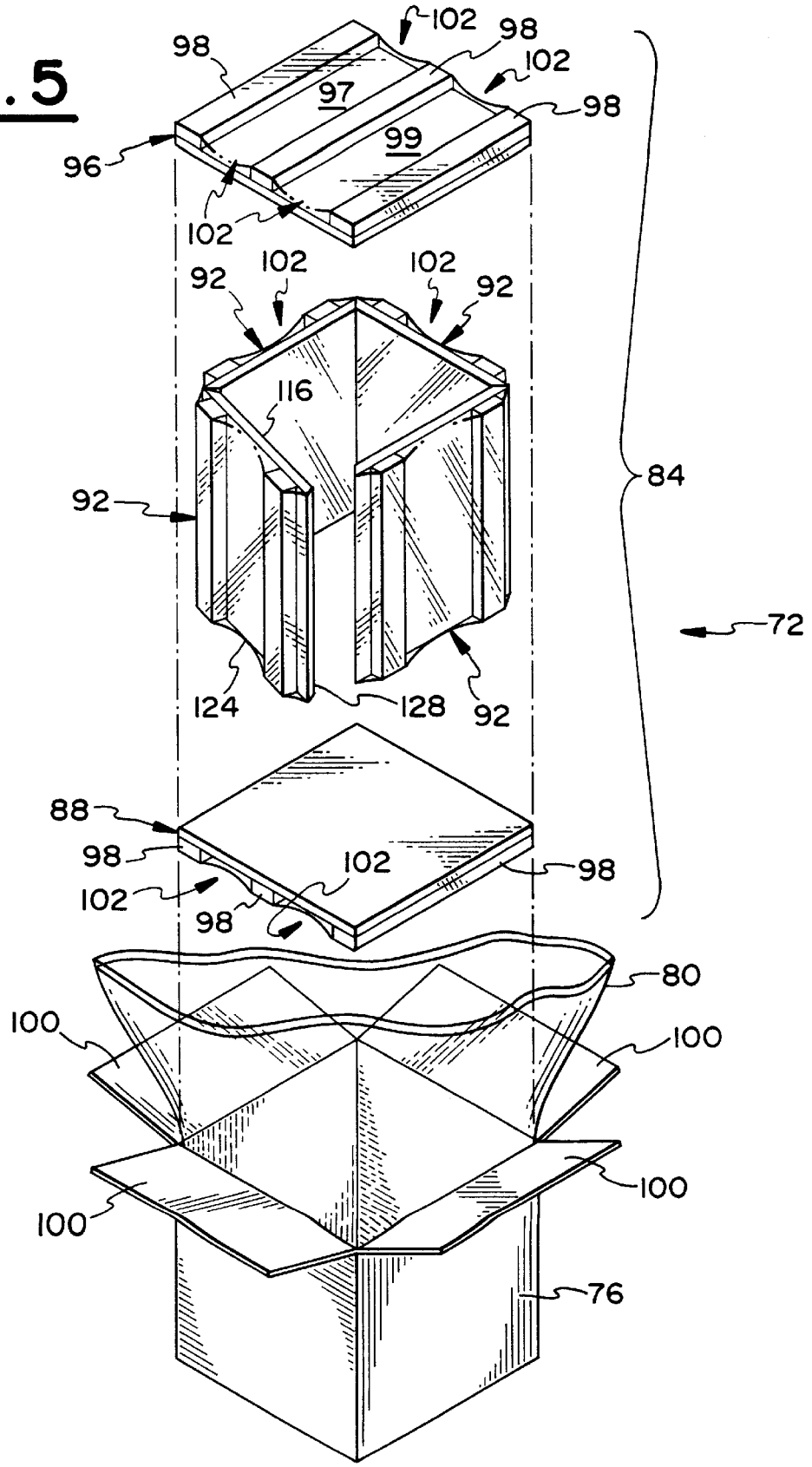
FIG. 5 is an exploded isometric view of a shipping container using a plurality of insulating panel members made in accordance with the present invention.
Figure 6:
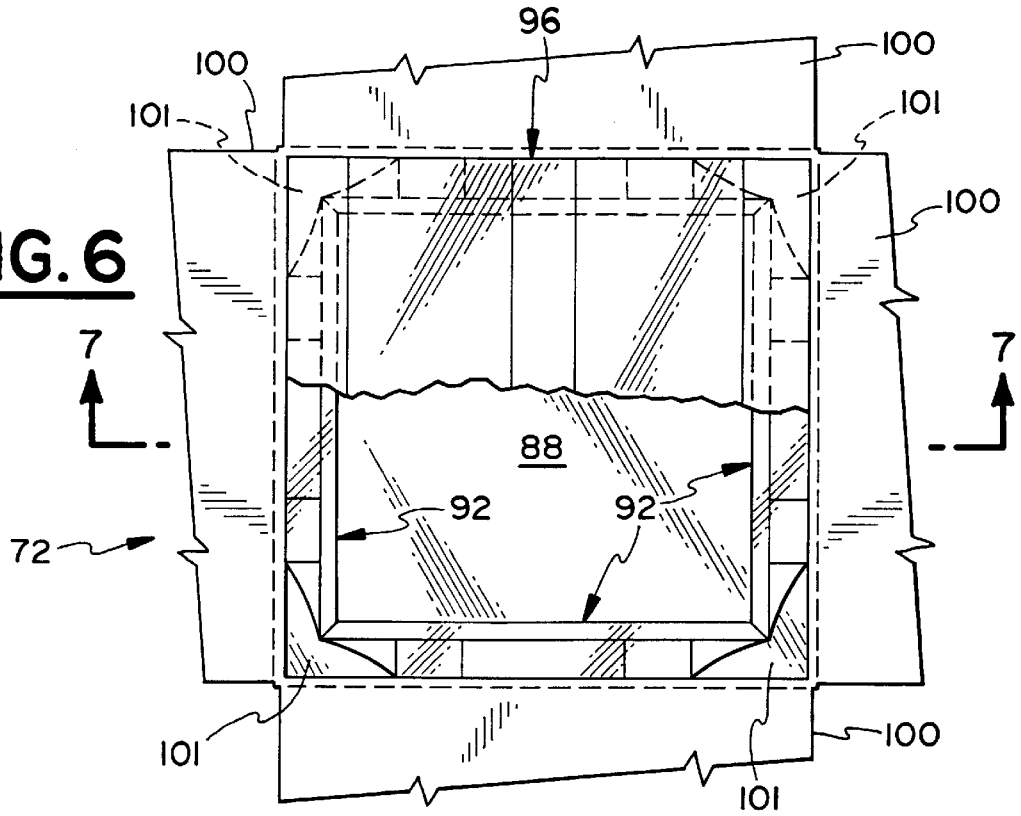
FIG. 6 is a top view of the shipping container shown in FIG. 5.

FIG. 5 displays an insulated shipping container 72, comprising a box 76, an optional bag or enclosing device 80, and an insulating assembly 84.

Insulating assembly 84 is comprised of a bottom panel 88, side panels 92 and a top panel 96.

Box 76 has closing flaps 100 so when the insulating assembly 84 is placed within box 76, box 76 can be closed and sealed. Box 76 may be a conventional corrugated cardboard box.

Closing device 80 may be of a conventional sealable plastic bag. Device 80, being disposed in box 76 will prevent any liquid leakages from the cargo from damaging box 76 or leaking through box 76.

Insulating assembly 84 is comprised of a bottom panel 88, side panels 92 and a top panel 96. These panels are generally made in accordance with the disclosure above, with regard to creating dead air spaces between the ribs, panels and plastic film. Note, top panel 96 and bottom panel 88 each have three ribs 98, as shown, with two dead air spaces, 97 and 99. Note, reflective material may also be used in conjunction with top panel 96 and bottom panel 88.

The insulating shipping container 72 is made by providing box 76; optionally placing closing device 80 within box 76. Then placing bottom panel 88 along the bottom of box 76. Side panels 92 are placed along the inside surface of the walls of box 76 and on bottom panel 88. Top panel member 96 is disposed along a side 116, discussed below, of each side member 92. This forms a closure between bottom panel 96, side members 92, and bottom panel 88. Bag 80 can then be sealed, if applicable. Flaps 100 of box 76 can then be closed and sealed with tape, or the like.

A plurality of air compartments 101 and 102 are defined by the film on panels 88, 92 and 96, and the interior surface of box 76.

Air compartments 101 are disposed adjacent the edges of panels 92. Air compartments 102 are disposed between the ribs of panels 88, 92 and 96, the film and the interior surface of box 76. If closing device 80 is employed, then air compartments 101 and 102 are defined by the film on panels 88, 92 and 96, and closing device 80.

Figure 7:
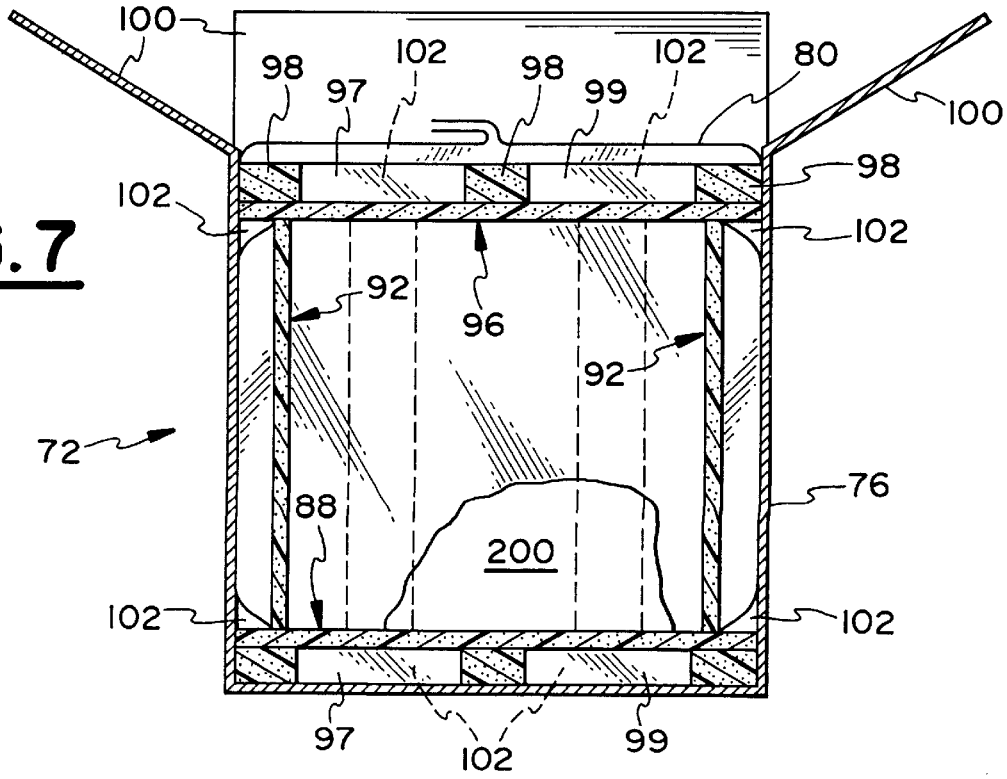
FIG. 7 is a cross sectional view of the shipping container of FIG. 5 taken along the line 7—7 of FIG. 6.

Shown only in FIG. 7, is a piece of cargo 200. Cargo 200 is generally a temperature sensitive material. Cargo 200 is placed upon bottom panel 88.

FIGS. 8 AND 9

FIG. 8 displays one of a representative side panels 92. Each side panels 92 is comprised of a base member 104, first rib 132 and a second rib 136. Base member 104 and ribs 132 and 136 are wrapped in a heat shrinkable film 140, so as to create a first dead air space 144, and second dead air space 148 and a third dead air space 152 between film 140, ribs 132 and 136 and a first surface 108 of base 104.

Base member 104 also includes a second surface 112, a first side 116, a second side 120, a third side 124 and a forth side 128 (see also FIG. 5). Second side 120 and forth side 128 are mitered edges. Preferably, mitered edges or sides 120 and 128 are disposed at an angle of about 45 degrees to second surface 112 and first surface 108. Those skilled in the art will realize that sides 116 and 124 could alternatively be the mitered sides rather than sides 120 and 128. Also, those skilled in the art will realize that mitered edges 128 to 120 will be disposed at an angle to second surface 112 and first surface 108 which is dictated by the overall configuration of the insulated container 72. Note, panels 92 may optionally have reflective layers or material 156 disposed on the surfaces of the ribs, 132 and 136 and base member 104.

As shown on FIG. 9, as well as previously shown in FIG. 4, side panels 92 are arranged with the mitered edges or sides 120 and 128 of each side panel 92 in alignment and being coextensive with each other. FIG. 9 shows a connector 160 connecting two side panels 92. Connector 160 can be a piece of conventional tape or packing tape. Having the mitered edges 120 and 128 of each side panel 92 mate with each other, it allows the side panels to collectively from a four-walled assembly for placement within box 76.

Note, the particular panels shown for the top, bottom and side panels are not mandatory. In other words, rather than using three ribs for top and bottom panels 96 and 88, four, five or even more or less may be used. Likewise, more or less ribs may be used in connection with side panels 92. Additionally, the positional relationship between the ribs and the ends for each panel may be varied also, as is shown in FIGS. 10 and 11, and discussed below.

FIGS. 10 AND 11

FIGS. 10 and 11 display an alternative embodiment of a reusable insulating panel 210, made in accordance with the present invention, for use with a shipping container.

Panel 210 comprises a base member 214, a first rib 218, a second rib 222, and a film 226 wrapped around base member 214 and ribs 218 and 222, creating a first, second and third independent dead air compartments, 230, 234 and 238, respectfully. As with the other air spaces and compartments mention above, these compartments 230, 234 and 238 are independent and air may not freely transfer from one to another. Thus, convection is reduced between a first end 242 of base member 214 and an opposite second end 246 of base member 214.

Panel 210 discloses an alternative arrangement or positioning of the ribs. Ribs 218 and 222 are not in a parallel relationship with ends 242 and 246. Note, the ribs discussed above have been discussed as being in a parallel relationship.

Panel 210 is only one of many variations that may be employed with regard to how the ribs are disposed on a base member or panel. Ribs can be arranged on a panel, in accordance with this invention as disclosed above, in nearly any fashion so as to create independent air compartments that extend across the face of the panel.

For all the panels and containers disclosed above, the ribs associated with each, also act to distance the shipping cargo from the container walls. Thus, if an object punctures a wall of the container, the object will not necessarily reach and damage the cargo. See FIG. 7 for an example of how side, bottom and top panels, 92, 88 and 96, respectively, keep cargo 200 at a distance from the walls of box 76.

Those skilled in the art can appreciate that the insulating properties or the R-value of the panels disclosed herein is related to the thickness of the base members and the amount of dead air space. Consequently, the thicknesses of the base members and rib members are chosen with knowledge of the amount of transit time required and the temperature beyond which the contents or cargo to be transported cannot be subjected to.

While this invention has been described as having a preferred design, it is understood that it is capable of further modification, uses and/or adaption following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. An insulated container, comprising:

a) a plurality of side members being at least partially interconnected;

b) a closure member being selectively engaged with said side members defining an interior space; and, c) at least one of said plurality of side members comprising:

i) a base panel having edges and an exterior surface;

ii) a rib disposed on said exterior surface of said base panel; and, iii) a film partially sheathing said rib and said base member forming a first chamber and a second chamber between said rib and said edges, said chambers being independent from one another substantially preventing convection flow between said chambers.

2. An insulated container as recited in claim 1, wherein:

a) said base panel further comprising an inner surface and a thickness measured between said exterior and inner surfaces;

b) said at least one rib further comprising a free surface, an attachment surface and a rib thickness measured between said free and attachment surfaces; and, c) said rib thickness being greater in measurement than said thickness of said base panel.

3. An insulated container as recited in claim 2, wherein:

a) said rib thickness is about two times greater in measurement than said thickness of said base panel.

4. An insulated container as recited in claim 1, wherein:

a) said base panel further comprising a width;

b) said at least one rib further comprising a rib width; and, c) said width of said base panel being greater in measurement than said rib width.

5. An insulated container as recited in claim 4, wherein:

a) said width of said base panel is about nine times greater in measurement than said rib width.

6. An insulated container as recited in claim 1, wherein a) said base panel having a generally rectangular cross section.

7. An insulated container as recited in claim 1, wherein:

a) said at least one rib having a generally rectangular cross section.

8. An insulated container as recited in claim 1, wherein:

a) said at least one of said plurality of side members and said at least one closure member further comprising a second rib being disposed on said base panel and spaced apart from said at least one rib;

b) said film partially sheathing said second rib creating a third chamber between said base panel, said film, said at least one rib and said second rib; and, c) said first and second chambers and said third chamber being substantially independent from one another and substantially preventing convection flow between said chambers.

9. An insulated container as recited in claim 1, wherein:

a) said side members having two vertical edges; and, b) said vertical edges being mitered.

10. An insulated container, as recited in claim 1, further comprising:

a) a box defining an interior volume adapted to receive said plurality of side members and said closure member.

11. An insulated container, as recited in claim 10, wherein:

a) said box having an interior surface; and, b) a plurality of air compartments defined by said film and said interior surface of said box.

12. An insulated container, as recited in claim 11, wherein:

a) one of said plurality of air compartments disposed adjacent said edges of said base panel.

13. An insulated container, as recited in claim 11, further comprising:

a) a second rib disposed on said exterior surface of said base panel of at least one of said plurality of side members; and, b) one of said plurality of air compartments disposed adjacent said rib, said second rib, said film and said interior surface of said box.

14. An insulated container, as recited in claim 10, further comprising:

a) a closing device disposed within said interior volume of said box, and having a sealable volume operably adapted to receive said plurality of side members and said closure member.

15. An insulated container, as recited in claim 1, wherein:

a) said closure member includes a base panel having edges and an exterior surface, a rib disposed on said exterior surface of said base panel of said closure member and a film partially sheathing said rib and said base member of said closure member, forming a first chamber and a second chamber between said rib of said closure member and said edges of said base panel of said closure member, said chambers being independent from one another substantially preventing convection flow between said chambers.

16. An insulated container, as recited in claim 15, further comprising:

a) a box defining an interior volume adapted to receive said plurality of side members and said closure member.

17. An insulated container, as recited in claim 16, wherein:

a) said box having an interior surface; and, b) a plurality of air compartments defined by said film of said closure member and said interior surface of said box.

18. An insulated container, as recited in claim 17, further comprising:

a) a second rib disposed on said exterior surface of said base panel of said closure member; and, b) one of said plurality of air compartments disposed adjacent said rib, said second rib and said film of said closure member and said interior surface of said box.

19. An insulated container, as recited in claim 1, further comprising:

a) a second closure member engaging said side members further defining said interior space.

20. An insulated container, as recited in claim 19, wherein:

a) said second closure member having a base panel with edges, a rib disposed on said base panel of said second closure member, and a film partially sheathing said rib of said second closure member and said base panel of said second closure member, forming a first chamber and a second chamber between said rib of said second closure member and said edges of said base panel of said second closure member, said chambers being independent from one another substantially preventing convection flow between said chambers.

21. An insulated container, as recited in claim 19, further comprising:

a) a box defining an interior volume adapted to receive said plurality of side members, said closure member and said second closure member.

22. An insulated container, as recited in claim 21, wherein:

a) said box having an interior surface; and, b) a plurality of air compartments defined by said film of said second closure member and said interior surface of said box.

23. An insulated container, as recited in claim 22, further comprising:

a) a second rib disposed on said exterior surface of said base panel of said second closure member; and, b) one of said plurality of air compartments disposed adjacent said rib, said second rib and said film of said second closure member, and said interior surface of said box.

24. A reusable insulated container, comprising:

a) a plurality of side members each having a top edge and a bottom edge:

b) a top member being selectively disposed on said top edges of said plurality of side members defining an interior space; and, c) said side members each comprising:

i) a base panel having edges and an exterior surface;

ii) a rib disposed on said exterior surface of said base panel; and, iii) said base panel and said rib being partially sheathed in a film forming separate independent air pockets between said rib and said edges of said base panel.

25. A reusable insulated container as recited in claim 24, a further comprising:

a) a bottom member being selectively engaged with said bottom edges of said plurality of said side members; and, b) said bottom member comprising:

i) a base panel having edges and an exterior surface;

ii) a rib disposed on said exterior surface of said base panel; and, iii) said base panel and said rib of said bottom member being partially sheathed in a film forming separate independent air pockets between said rib of said bottom member and said edges of said base panel of said bottom member.

26. A reusable insulated container, as recited in claim 25, further comprising:

a) a box defining an interior volume adapted to receive said plurality of side members, said top member and said bottom member.

27. A reusable insulated container, as recited in claim 26, wherein:

a) said box having an interior surface; and, b) a plurality of air compartments defined by said film of said bottom member and said interior surface of said box.

28. A reusable insulated container, as recited in claim 27, further comprising:

a) a second rib disposed on said exterior surface of said base panel of said bottom member; and, b) one of said plurality of air compartments disposed adjacent said rib, said second rib and said film of said bottom member, and said interior surface of said box.

29. A reusable insulated container as recited in claim 24, wherein:

a) said side members having two side edges opposite each other; and, b) said two side edges being mitered and said top and bottom edges being non-mitered.

30. A reusable insulated container as recited in claim 29, wherein:

a) said base panel further comprising an inner surface, and a thickness measured between said inner and exterior surfaces;

b)said at least one rib further comprising a free surface, an attachment surface and a rib thickness measured between said free and attachment surfaces; and, c) said rib thickness being greater in measurement than said thickness of said base panel.

31. A reusable insulated container as recited in claim 30, wherein:

a) said rib thickness is about two times greater in measurement than said thickness of said base panel.

32. A reusable insulated container, as recited in claim 24, further comprising:

a) a box defining an interior volume; said interior volume adapted to receive said plurality of side members and said top member.

33. A reusable insulated container, as recited in claim 32, wherein:

a) said box having an interior surface; and, b) a plurality of air compartments defined by said film and said interior surface of said box.

34. A reusable insulated container, as recited in claim 33, wherein:

a) one of said plurality of air compartments disposed adjacent said edges of said base panel.

35. A reusable insulated container, as recited in claim 33, further comprising:

a) a second rib disposed on said exterior surface of said base panel of each of said side members; and, b) one of said plurality of air compartments disposed adjacent said rib, said second rib, said film and said interior surface of said box.

36. A reusable insulated container, as recited in claim 32, further comprising:

a) a closing device disposed within said interior volume of said box, having a sealable volume operably adapted to receive said plurality of side members and said top member.

37. A reusable insulated container, as recited in claim 24, wherein:

a) said top member includes a base panel having edges and an exterior surface, a rib disposed on said exterior surface of said base panel of said top member, said base panel and said rib of said top member partially sheathed in a film forming separate independent air pockets between said rib of said top member and edges of said base panel of said top member.

38. A reusable insulated container, as recited in claim 37, further comprising:

a) a box defining an interior volume adapted to receive said plurality of side members and said top member.

39. A reusable insulated container, as recited in claim 38, wherein:

a) said box having an interior surface; and, b) a plurality of air compartments defined by said film of said top member and said interior surface of said box.

40. A reusable insulated container, as recited in claim 39, further comprising:

a) a second rib disposed on said exterior surface of said base panel of said top member; and, b) one of said plurality of said air compartments disposed adjacent said rib, said second rib and said film of said top member and said interior surface of said box.

* * * * *